US008317529B2

(12) United States Patent
Katano

(10) Patent No.: US 8,317,529 B2
(45) Date of Patent: Nov. 27, 2012

(54) CONTACT AND ELECTRICAL CONNECTOR

(75) Inventor: Tetsuya Katano, Kanagawa (JP)

(73) Assignee: Tyco Electronics Japan G.K., Kanagawa-Ken (JP)

( * ) Notice: Subject to any disclaimer, the term of this patent is extended or adjusted under 35 U.S.C. 154(b) by 0 days.

(21) Appl. No.: 13/191,898

(22) Filed: Jul. 27, 2011

(65) Prior Publication Data

US 2012/0028507 A1 Feb. 2, 2012

(30) Foreign Application Priority Data

Jul. 30, 2010 (JP) ..... 2010-172816

(51) Int. Cl.
*H01R 13/64* (2006.01)

(52) U.S. Cl. ..... 439/251

(58) Field of Classification Search ..... 439/251, 439/246, 249, 857, 660; 200/246
See application file for complete search history.

(56) References Cited

U.S. PATENT DOCUMENTS 4,108,531 A * 8/1978 Reynolds ..... 439/831
5,035,651 A * 7/1991 Dixon et al. ..... 439/607.17
5,049,092 A * 9/1991 Takano et al. ..... 439/540.1
5,611,717 A * 3/1997 Joly ..... 439/857
5,655,935 A * 8/1997 Yoshimura ..... 439/748
6,634,911 B1 * 10/2003 Billman et al. ..... 439/884
7,044,811 B2 * 5/2006 Chritz et al. ..... 439/856
7,140,895 B2 11/2006 Tuin et al.
7,556,515 B2 * 7/2009 Kato et al. ..... 439/171
7,575,487 B2 * 8/2009 Yodogawa ..... 439/830
7,581,972 B2 * 9/2009 Daamen ..... 439/249
7,740,511 B2 6/2010 Katano
7,909,620 B2 * 3/2011 Masaki et al. ..... 439/81
8,057,247 B2 * 11/2011 Katano ..... 439/251
8,113,859 B2 * 2/2012 Kim ..... 439/239

* cited by examiner

*Primary Examiner* — Amy Cohen Johnson
*Assistant Examiner* — Vladimir Imas
(74) *Attorney, Agent, or Firm* — Barley Snyder

(57) ABSTRACT

A contact having a contact section, a pair of tabs, and a pair of springs. The contact section includes a pair of arms extending frontward while facing each other and a support bearing the pair of arms. The pair of tabs are located on left and right sides of the contact with the contact section positioned between. The pair of springs having a sheared surface and bend from both left and right sides of the support respectively. Additionally, the pair of springs first bend outwardly to right and left away from the contact section, around respective central axes extending vertically and maintain the sheared surface facing up and down. Then, the pair of springs extend backward to link to the pair of tabs, respectively, the pair of springs supporting the contact section.

40 Claims, 10 Drawing Sheets

CONTACT AND ELECTRICAL CONNECTOR

CROSS-REFERENCE TO RELATED APPLICATIONS

This application claims the benefit of the filing date under 35 U.S.C. §119(a)-(d) of Japanese Patent Application 2010-172816, filed Jul. 30, 2010.

FIELD OF THE INVENTION

The invention relates to an electrical connector and in particular to an electrical connector having a contact to make contact with and electrically couple with a mating contact.

BACKGROUND

A known example of such a contact is disclosed in Japanese Patent Application Laid-open Publication No. 2006-19296. A contact section of the disclosed type of contact includes a spring for pinching a mating contact to maintain a contacting state even when the mating contact moves relative to the contact.

A known contact 800, shown in FIG. 10, includes a U-shaped contact section 801, a pair of leg sections 802 to be connected to a circuit board, a pair of free ends 803 provided in the contact section 801, and a pair of flat springs 804 that respectively extend from the pair of free ends 803 and each bend 180 degrees at two points on the way to the corresponding leg section 802. The leg sections 802 are connected to the circuit board (not shown) by solder, and the U-shaped contact section 801 pinches a mating contact to establish electrical connection therewith (not shown).

In the contact 800, the two free ends 803, positioned on both sides of the mating contact, are directly linked to the separate springs 804 respectively. For this reason, when vibration or shock is applied to the mating contact, space is momentarily formed between the two free ends 803 and the mating contact, which may break electrical connection.

Thus, there is proposed a contact having such a structure that a pair of arms are supported by a support, and this support is supported by a pair of springs in a displaceable manner (see, for example, Japanese Patent Laid-Open No. 2008-98052.)

FIGS. 11A and 11B are perspective views of another known contact that is different from that in FIG. 10. The contact 900, shown in FIGS. 11A and 11B, includes a pair of arms 902 and 903 that extend forward while facing each other, a plate-shaped support 904 that supports the arms 902 and 903, a pair of springs 905 and 906 that bend at and extend from both sides of the support in a left-right direction that is a direction in which the arms 902 and 903 face each other, and tabs 908 and 909 provided at the respective tips of the springs 905 and 906. The contact 900 is fixed to a cover (not shown) of the connector when the tabs 908 and 909 are press-fit into the cover. The arms 902 and 903 that hold the mating contact (not shown) move together with the support 904 by following the mating contact.

The tabs 908 and 909 in the contact 900 shown in FIGS. 11A and 11B are disposed frontward like the tips of the arms 902 and 903, extending from the support 904. Besides, the tabs 908 and 909 are aligned with the tips of the arms 902 and 903 in the left-right direction in which the arms 902 and 903 facing each other pinch the mating contact. In other words, the tabs 908 and 909 are disposed on both sides between which the tips of the arms 902 and 903 are interposed. For this reason, a range in which the tips of the arms 902 and 903 may move is limited to a range between the tabs 908 and 909 (to be exact, a range in the cover where the contact 900 is disposed, the range being narrower by the thickness of press-fit parts of the cover into which the tabs 908 and 909 are press-fit). If an attempt is made to secure the range in which the tips of the arms 902 and 903 move by following the mating connect, while avoiding interference with the tabs 908 and 909, it is necessary to dispose the tabs 908 and 909 with a wider space in between. Thus, in a case in which plural contacts are aligned and disposed, it is impossible to place them by narrowing the pitch between the contacts.

Further, the contact illustrated in FIG. 10 and the contact illustrated in FIGS. 11A and 11B need to be bent around axes extending in different directions to form the basic structure, which complicates the operation when forming is performed by a manufacturing machine.

SUMMARY

The invention has been made in view of the above circumstances and provides a contact in which electrical connection is hard to break, in which a shifting range of contact arms is widened, and which is easy to produce, and an electrical connector having the contact.

A contact having a contact section, a pair of tabs, and a pair of springs. The contact section includes a pair of arms extending frontward while facing each other and a support bearing the pair of arms. The pair of tabs are located on left and right sides of the contact with the contact section positioned between. The pair of springs having a sheared surface and bend from both left and right sides of the support respectively. Additionally, the pair of springs first bend outwardly to right and left away from the contact section, around respective central axes extending vertically and maintain the sheared surface facing up and down. Then, the pair of springs extend backward to link to the pair of tabs, respectively, the pair of springs supporting the contact section.

BRIEF DESCRIPTION OF THE DRAWINGS

The invention is described in more detail in the following with reference to the embodiments shown in the drawings. Similar or corresponding details in the Figures are provided with the same reference numerals. The invention will be described in detail with reference to the following figures of which.

DETAILED DESCRIPTION OF THE EMBODIMENT(S)

Figure 1A:
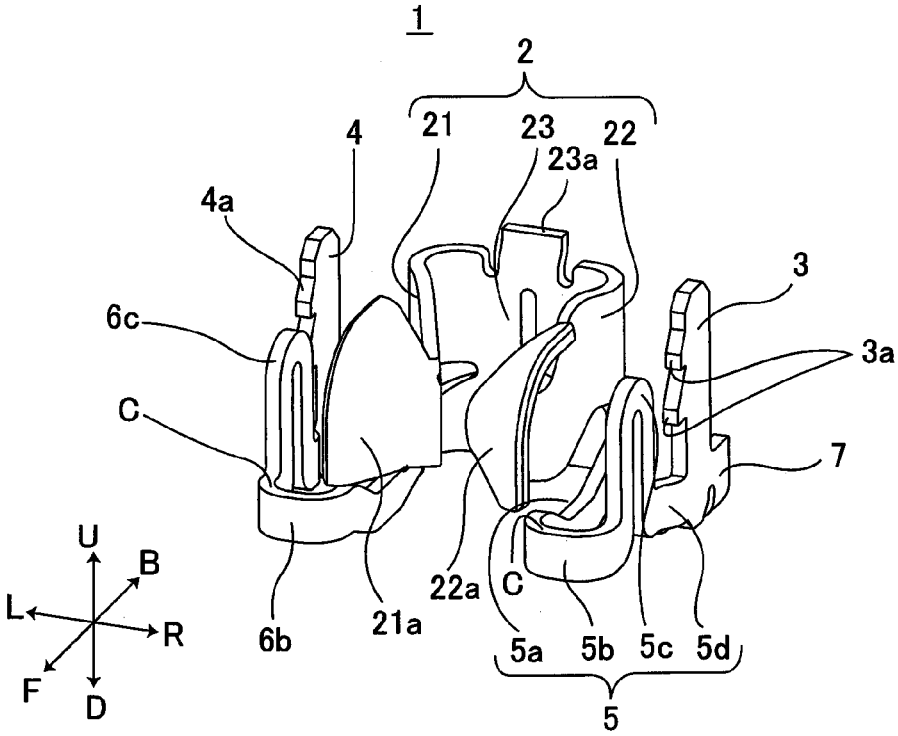
FIG. 1A is a perspective view of a contact according to the invention.

Embodiments of the contact and the electrical connector according to the present invention will be described below with reference to the drawings.

FIG. 1A through FIG. 2D are external views of a contact according to the invention. The contact 1 is, for example, a component for being connected by soldering to a conductor pattern on a printed circuit board (not shown), and for electrically contacting and thereby being coupled to a mating contact that will be described later. The contact 1 includes a contact section 2, a pair of tabs 3 and 4, a pair of springs 5 and 6, and a pair of substrate connectors 7 and 8. The contact 1 is produced by stamping and forming sheet metal. The contact section 2, the tabs 3 and 4, the springs 5 and 6, and the substrate connectors 7 and 8 are formed integrally as one piece.

The contact section 2 includes a pair of arms 21 and 22 extending while facing each other, and a flat support 23 being connected to and thereby supporting the arms. The arms 21 and 22 extend after bending 90 degrees from both sides in a left-right direction LR in which the arms 21 and 22 of the support 23 face each other. Here, in the contact 1, a direction in which the arms 21 and 22 extend from the support 23 is referred to as a frontward direction F, and a direction opposite to the frontward direction F is referred to as a backward direction B. Further, directions in which the arms 21 and 22 face toward each other are referred to as a right direction R and a left direction L, respectively, and the left-right direction LR in which the arms 21 and 22 face each other is also referred to as a facing direction LR. Furthermore, a direction in which the tabs 3 and 4 extend is referred to as an upward direction U, and a direction opposite to the upward direction U is referred to as a downward direction D.

The pair of arms 21 and 22 extend frontward after bending at both sides in the left-right direction LR of the support 23, and the arms 21 and 22 are provided with spherical connection pads 21*a* and 22*a* at the respective tips. The arms 21 and 22 are disposed so that a gap between the connection pads 21 a and 22*a* is smaller than the thickness of a mating contact 331 (see FIG. 6). When the mating contact shaped like a plate is inserted between the arms 21 and 22, the arms 21 and 22 elastically deform so that the gap between the connection pads 21*a* and 22*a* widens and receives the mating contact, and at the same time, the arms 21 and 22 hold the mating contact with the connection pads 21*a* and 22*a* by applying pressure from both sides in the left-right direction LR. The connection pads 21*a* and 22*a* have the respective curved surfaces spherically bulging toward each other and thus, the mating contact interposed between the connection pads 21*a* and 22*a* is prevented from being damage. Further, the arms 21 and 22 extend in the frontward direction F after bending at both sides in the left-right direction LR of the support 23 and thus, the arms 21 and 22 may receive the mating contact in the backward direction B, i.e. toward a deeper side, up to a position of the support 23. A convex section 23*b* is positioned in a central part of the support 23, which bulges in the backward direction B by embossing and extend in the upward and downward directions UD, so that the strength against bending of the support 23 is increased. Furthermore, a projection 23*a* is positioned along the upper end of the support 23.

The springs 5 and 6 link the tabs 3 and 4 to the support 23. Specifically, the springs 5 and 6 bend at both sides in the left-right direction LR from the support 23, respectively, and then extend in the frontward direction F further than the tabs 3 and 4, and subsequently, the springs 5 and 6 extend in the backward direction B and are connected to the tabs 3 and 4, respectively. To be specific, the springs 5 and 6 include: first extending sections 5*a* and 6*a* that extend from the support 23 in the frontward direction F; first U-shaped sections 5*b* and 6*b* that are bent outward in the left-right direction LR to be away from the contact section 2; second U-shaped sections 5*c* and 6*c* that extend in the upward direction U from the first U-shaped sections 5*b* and 6*b* and then bend to the backward direction B and further extend in the downward direction D; and link sections 5*d* and 6*d* that link the respective lower ends of the second U-shaped sections 5*c* and 6*c* and the respective lower ends of the tabs 3 and 4, respectively. The arms 21 and 22 bend at both ends in the left-right direction LR of the support 23 at positions higher than the springs 5 and 6 in the upward direction U, and then extend in the frontward direction F.

Figure 3:
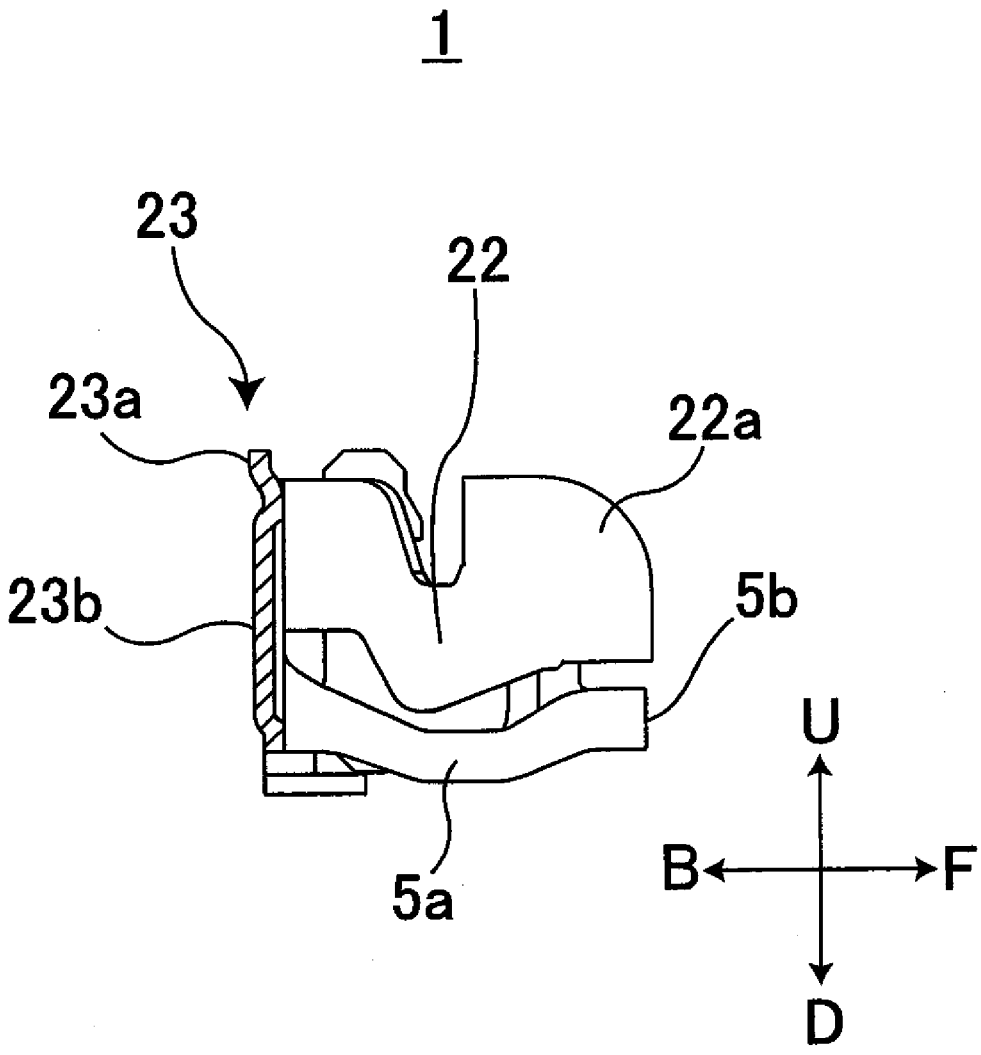
FIG. 3 is a cross-sectional diagram that illustrates a cross-section taken along a line 3-3 of the contact illustrated in FIGS. 2A to 2D.

As shown in FIG. 3, the contact arm 22 first extends in the forward direction F as well as obliquely the downward direction D, and further extends in the forward direction F, as well as obliquely the upward direction U. This also applies to the contact arm 21 positioned opposite the contact arm 22. The first extending section 5*a* has a shape of extending in the forward direction F as well as obliquely the downward direction D, and further extending in the forward direction F as well as obliquely the upward direction U, while avoiding coming into contact with the contact arm 22. This also applies to the first extending section 6*a* positioned opposite the first extending section 5*a*. The first U-shaped sections 5*b* and 6*b* each have a shape of curving around the central axis P (see FIGS. 1A and 1B) extending in the upward and downward directions UD, while keeping the sheared surface C facing up and down. In this shape, a curving part bulges forward, not downward and thus, the size in the upward and downward directions UD is reduced, compared to, for example, a shape in which a curve is formed around a central axis extending front and back and a sheared surface is made to face in forward and backward directions FR. For this reason, the first extending sections 5*a* and 6*a* following the first U-shaped sections 5*b* and 6*b* can be shaped to extend in the forward direction F as well as obliquely the downward direction D and further extend in the forward direction F as well as obliquely the upward direction U, while avoiding coming into contact with the contact arms 21 and 22 extending in the forward direction F as well as obliquely the downward direction D and further extending in the forward direction F as well as obliquely the upward direction U. As a result, in the contact arms 21 and 22, the size in the forward and backward directions FB, from the tips of the connection pads 21*a* and 22*a* that are the tips of these contact arms 21 and 22 to the support 23, is reduced while the length of the arm is maintained. Therefore, the contact 1 is reduced in size, while the range in which the contact arms 21 and 22 shift in the left and right directions LR is maintained.

The tabs 3 and 4 extend from the ends of the link sections 5*d* and 6*d* in the upward direction U. In the tabs 3 and 4, barbs 3*a* and 4*a* are formed to prevent removal after the pressfitting. When the tabs 3 and 4 are press-fit into a cover of an electrical connector that will be described later, the contact 1 is fixed to the cover. When the tabs 3 and 4 are press-fit into the cover, the contact section 2 is movably supported in the left-right direction LR by the springs 5 and 6 that are connected to these tabs 3 and 4 and elastically deform. As clearly shown in FIG. 2A, the link sections 5*d* and 6*d* are slightly bent outward in the left-right direction LR, so that the tabs 3 and 4 are disposed at positions outwardly away from each other in the left-right direction LR. As a result, the thickness of each fixing groove section 223 (see FIG. 6) of the cover that will be described later is adjusted.

The substrate connectors 7 and 8 are components of the contact to be connected to the circuit board (not shown) and the like by soldering, and extend from the lower ends of the tabs 3 and 4 in the backward direction B. The substrate connectors 7 and 8 have the respective tips bending 90 degrees inward along the left and right directions LR.

In the contact 1, because the springs 5 and 6 elastically deform, the contact section 2 is supported in the left-right direction LR to be movable together with the arms 21 and 22. Therefore, when the mating contact is moved in the left-right direction LR by external force in a state in which the mating contact is held by the arms 21 and 22 of the contact 1, the springs 5 and 6 elastically deform and both of the arms 21 and 22 move together with the support 23 by following the movement of the mating contact.

Figure 10:
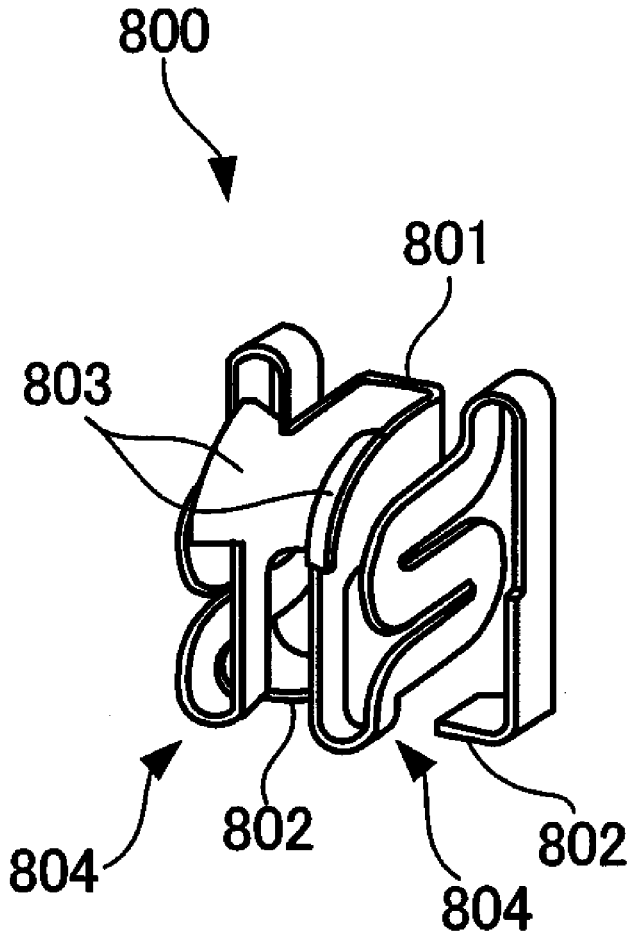
FIG.10 PRIOR ART
FIG. 10 is a perspective view of a known contact.

In contradistinction, in the known contact 800 in FIG. 10, the two free ends 803, positioned on both sides of the mating contact, are directly connected to the separate springs 804, respectively. For this reason, when vibration or shock is applied to the mating contact, one of the two springs 804 may not be able to follow the other and thereby a gap is momentarily formed between the two free ends 803 and the mating contact, leading to a break in the electrical connection.

Figure 11A:
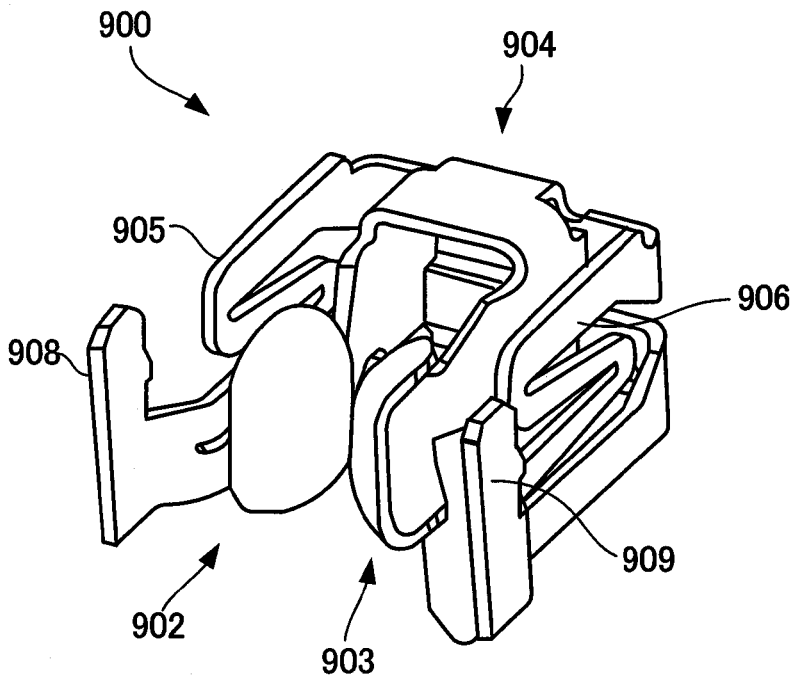
FIG.11A PRIOR ART
FIG. 11A is front perspective view of another known contact.
Figure 11B:
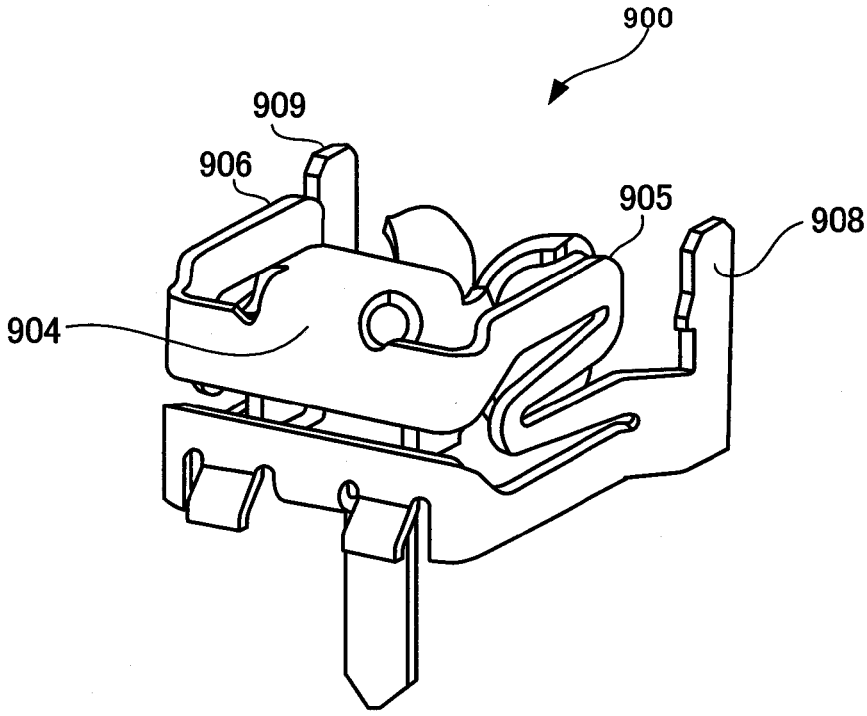
FIG.11B PRIOR ART
FIG. 11B is a rear perspective view of the contact in FIG. 10A.

The contact 1 has a different structure, such that the pair of arms 21 and 22 are generally connected to the support 23 and the pair of springs 5 and 6 are also connected to the support 23. For this reason, the pair of arms 21 and 22 move integrally with the support 23 supported by the springs 5 and 6. Therefore, even when shock is exerted, the condition in which the mating contact is held between the arms 21 and 22 is maintained, and electrical connection is maintained as well. Moreover, the contact 1 has such a structure that the springs 5 and 6 extend in the frontward direction F further than the tabs 3 and 4, then further extend in the backward direction B, and then are connected to the tabs 3 and 4. Therefore, the tabs 3 and 4 are located at positions further in the backward direction B than the connection pads 21*a* and 22*a* provided at the respective tips of the arms 21 and 22. For this reason, interference between the connection pads 21*a* and 22*a* of the arms 21 and 22 and the tabs 3 and 4 is avoided. Thus, as compared with the conventional structure in which tabs are disposed while being aligned with connection pads at the front as shown in FIGS. 11A and 11B, the range in which the arms 21 and 22 may move in the left-right direction LR is large. Further, in the contact 1 according to the invention, the connection pads 21*a* and 22*a* each have a spherical bulge. Therefore, the width in the left-right direction LR from one end to the other end of the tips of the arms 21 and 22 in the state in which the mating contact is interposed there between is equal to the thickness of the mating contact plus the respective heights of the bulges of the connection pads 21*a* and 22*a*. To allow the tips of the arms 21 and 22 to move by following the mating contact, it is necessary to ensure the space having a width equal to the sum of the thickness of the mating contact, the respective heights of the bulges of the connection pads 21*a* and 22*a*, and a displacement width of the tips of the arms 21 and 22. In the contact 1 according to the invention, interference between the tabs 3 and 4 and the connection pads 21*a* and 22*a* at the tips of the arms 21 and 22 is avoided and therefore, even though the connection pads 21*a* and 22*a* have the curved surfaces, the space for displacement is ensured sufficiently.

Subsequently, a process of producing the contact 1 will be described, with reference to FIG. 3, which shows the process of producing the contact 1 according to the invention. FIG. 3 illustrates the process of producing the contact from Part (A) to Part (C) sequentially.

Figure 4:
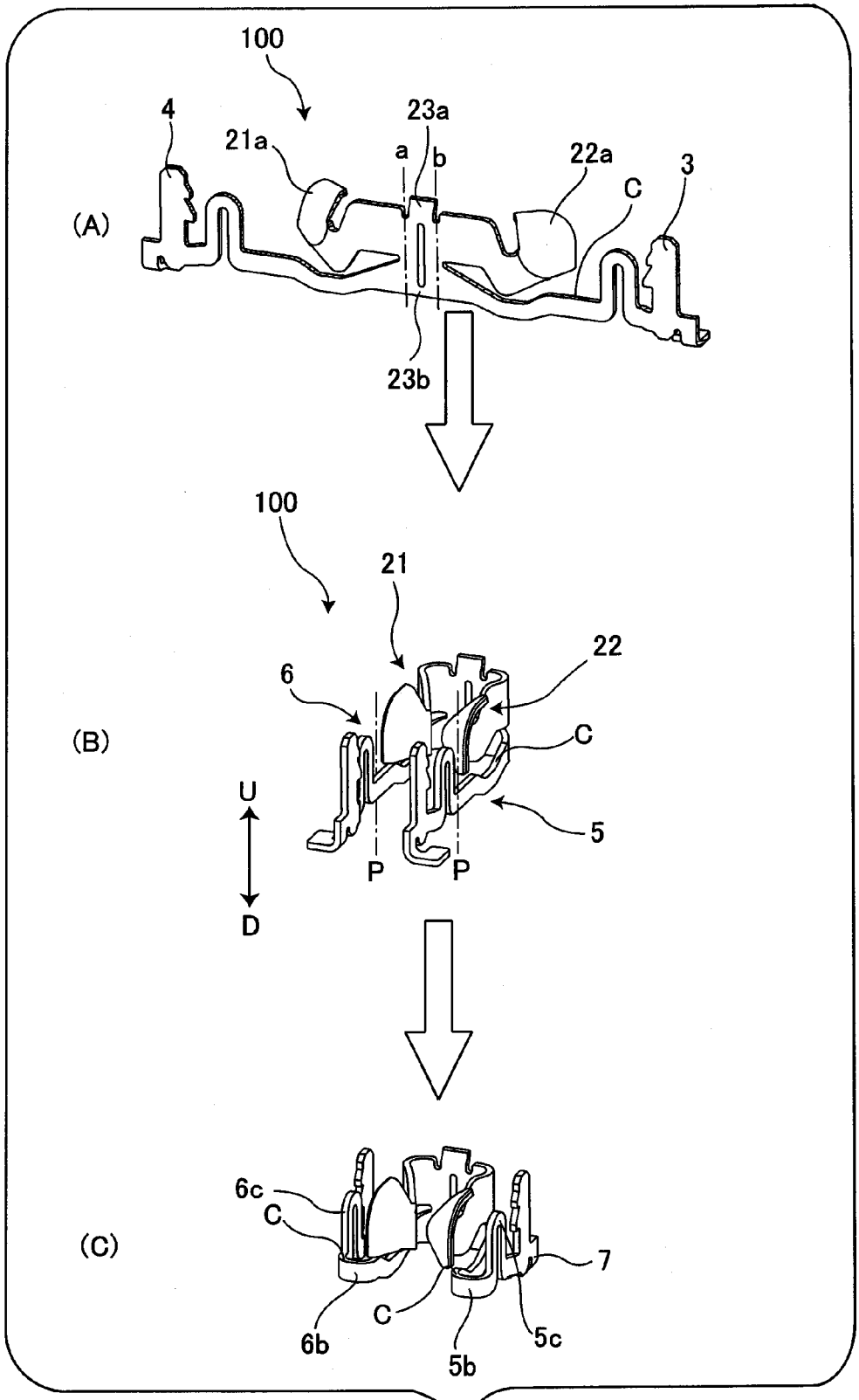
FIG. 4 is a perspective view of several steps in producing the contact of FIG. 1A.

The contact 1 is produced by stamping and forming sheet metal. As the sheet metal, for example, a thin sheet having high elasticity such as copper alloy is used. By stamping the sheet metal and bending the connection pads 21*a* and 22*a*, a contact material 100 shown in Part (A) of FIG. 4 is obtained. Incidentally, the contact material 100 is produced such that the metal plate is stamped so that plural contact materials 100 in a state of being linked to a carrier are obtained, each of the plural contact materials 100 are then formed while in the state of being linked to the carrier as shown in Part (A) through Part (C) of FIG. 4, and finally, the plural contact materials 100 are separated from each other. The carrier is omitted in FIG. 4, and only a part corresponding to one contact is shown. Incidentally, projection 23*a* and convex section 23*b* of the contact material shown in Part (A) are portions linked to the carrier and to be removed in the final stage to become the projection 23*a* (see FIGS. 1A and 1B) provided to project at the upper end of the support 23.

First, the contact material 100 is bent 90 degrees along a line a and a line b, so that the arms 21 and 22 and the springs 5 and 6 are formed (see FIG. 3 Part (A)). Further, the respective root parts of the tabs 3 and 4 are bent, accordingly. As illustrated in Part (A) of FIG. 4, each of the springs 5 and 6 is a portion extending like a belt with the sheared surface C facing in each of the upward and downward directions UD.

Next, the contact material 100 is folded 180 degrees around each of the central axes P extending in the upward and downward directions UD in the state in which the contact is completed, and thereby the first U-shaped sections 5*b* and 6*b* are formed (Part (B)). As shown in Part (C) of FIG. 4, each of the first U-shaped sections 5*b* and 6*b* is shaped to curve around the central axis P (see FIGS. 1A and 1B) extending in the upward and downward directions UD, while keeping the sheared surface C facing in each of the upward and downward directions UD. Further, the substrate connectors 7 and 8 are bent. It is to be noted that the shape of each of the second U-shaped sections 5*c* and 6*c* (see FIGS. 1A and 1B) is formed by stamping the metallic plate. In this way, the contact 1 is completed.

Figure 1B:
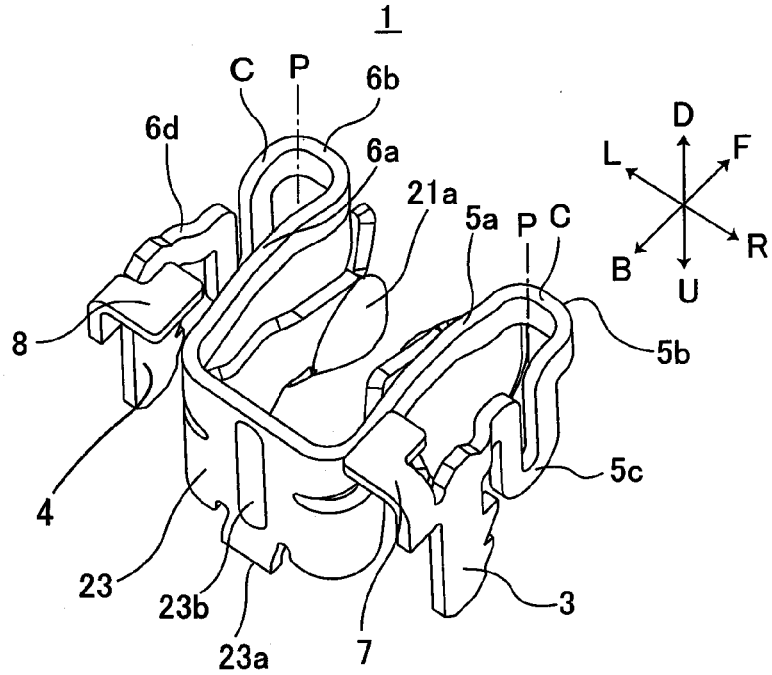
FIG. 1B is another perspective views of the contact in FIG. 1A.
Figure 2A:
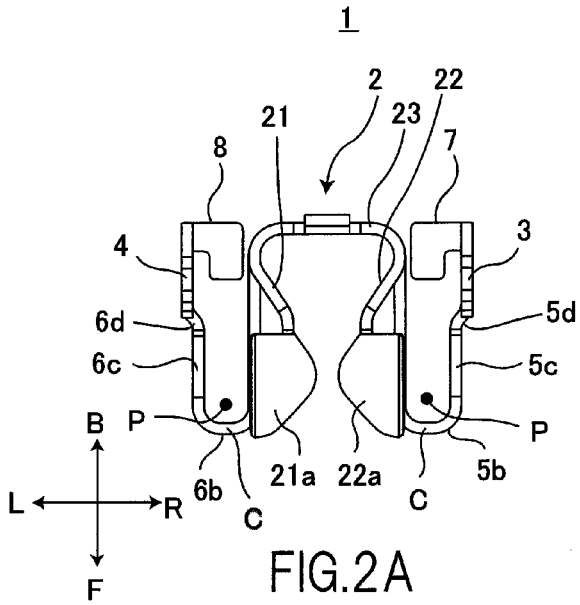
FIG. 2A is a top view of the contact of FIG. 1A.
Figure 2B:
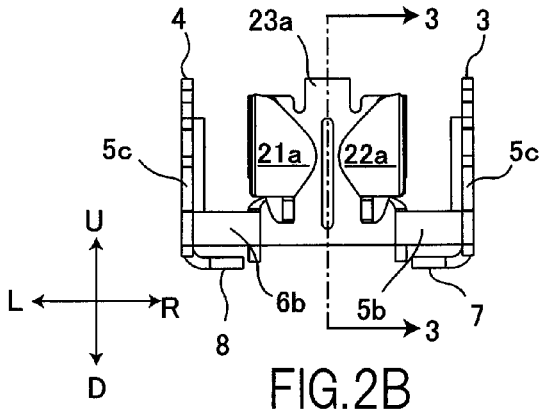
FIG. 2B is a front view of the contact of FIG. 1A.
Figure 2D:
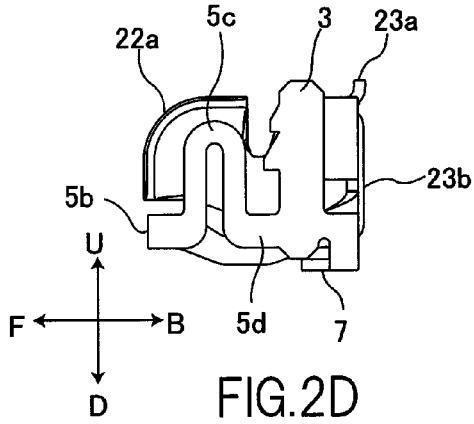
FIG. 2D is a side view of the contact of FIG. 1A.
Figure 2C:
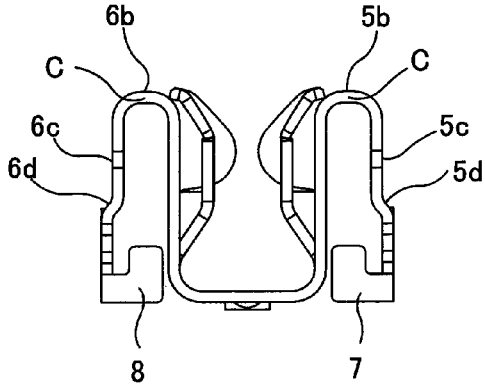
FIG. 2C is a bottom view of the contact of FIG. 1A.

In the contact 1 in FIGS. 1A and 1B, by bending the contact material shown in FIG. 3 into an angle of 90 degrees along each of the line a and the line b, the arms 21 and 22 are obtained that hold the mating contact along both sides in the left-right direction LR, as well as the first extending sections 5*a* and 6*a* extending toward the front of the springs 5 and 6. Further, the shape in which the first U-shaped sections 5*b* and 6*b* are bent outward on the left and right is obtained by bending the contact material 180 degrees in around the respective central axes P extending in the upward and downward directions UD. In this way, bending 180 degrees during the production only once for each of the left side and the right side is sufficient and thus, the contact 1 is easy to produce as compared to the known contact 800 in FIG. 10. Furthermore, each of the shape in which the springs 5 and 6 extend in the forward direction F and the shape in which the first U-shaped sections 5*b* and 6*b* bend outwardly right and left is formed by performing the folding to make a curve or a bend around each of the lines a and b and the central axes P which are in parallel with each other. For this reason, it is easy to perform the folding with a manufacturing machine.

Subsequently, a second embodiment of the present invention will be described.

Figure 5A:
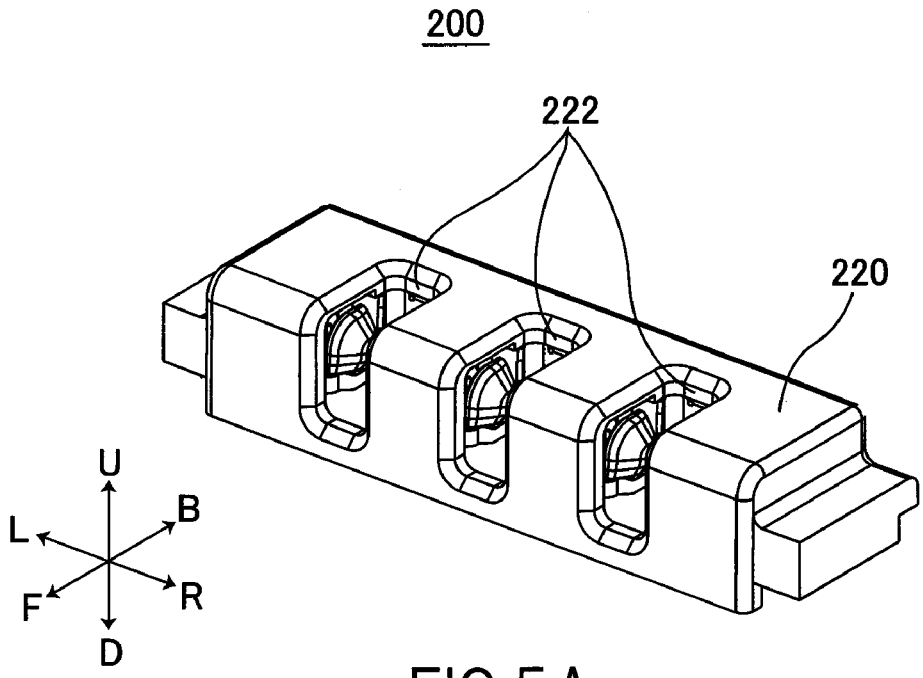
FIG. 5A is a top perspective view of an electrical connector according to the invention.
Figure 6:
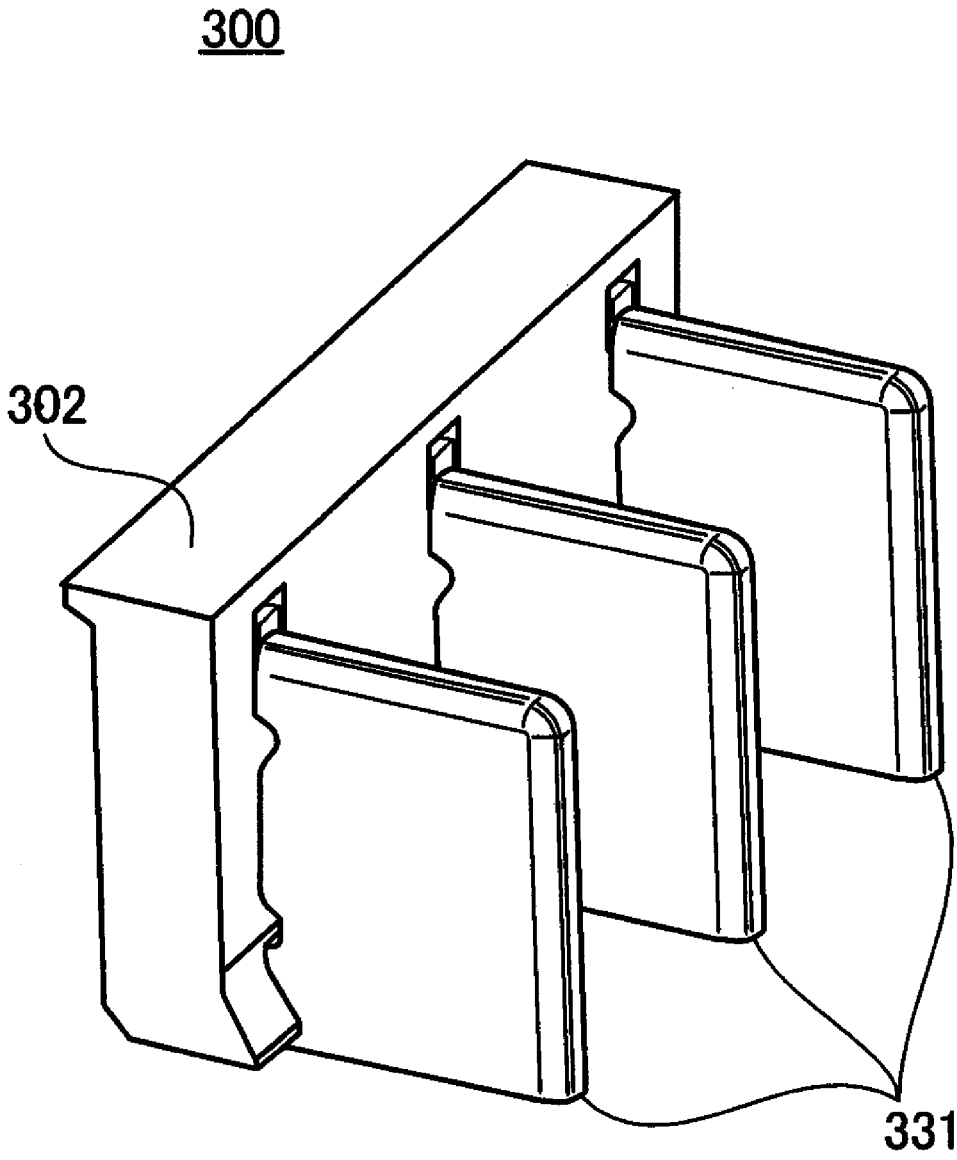
FIG. 6 is a perspective view of a mating connector.

With reference to FIGS. 5A and 4B, external appearances of an electrical connector 200 according to the invention is shown. The connector 200 is a component to which a mating connector 300 in FIG. 6 is to be connected. The connector 200 includes three contacts 1 in the embodiment shown, and a dome-shaped cover 220 that surrounds and protects the contacts 1. For example, the connector 200 is used in a thin battery unit to be mounted inside a cell telephone, and the connector 200 is connected to a circuit board in the thin battery unit by soldering and thereby used as a connector to be coupled to the mating connector 300 (see FIG. 6 provided in the cell telephone. The cover 220 becomes a part of a housing of the battery unit. The cover 220 is equivalent to an example of the connector housing according to the invention. FIG. 4B illustrates a bottom face of the electrical connector in a state in which the circuit board is removed.

Meanwhile, the mating connector 300 in FIG. 5 includes three flat mating contacts 331 disposed substantially in parallel with each other and made of a metallic material, and a fixing member 302 fixing the mating contact 331 and made of an insulating material.

Figure 5B:
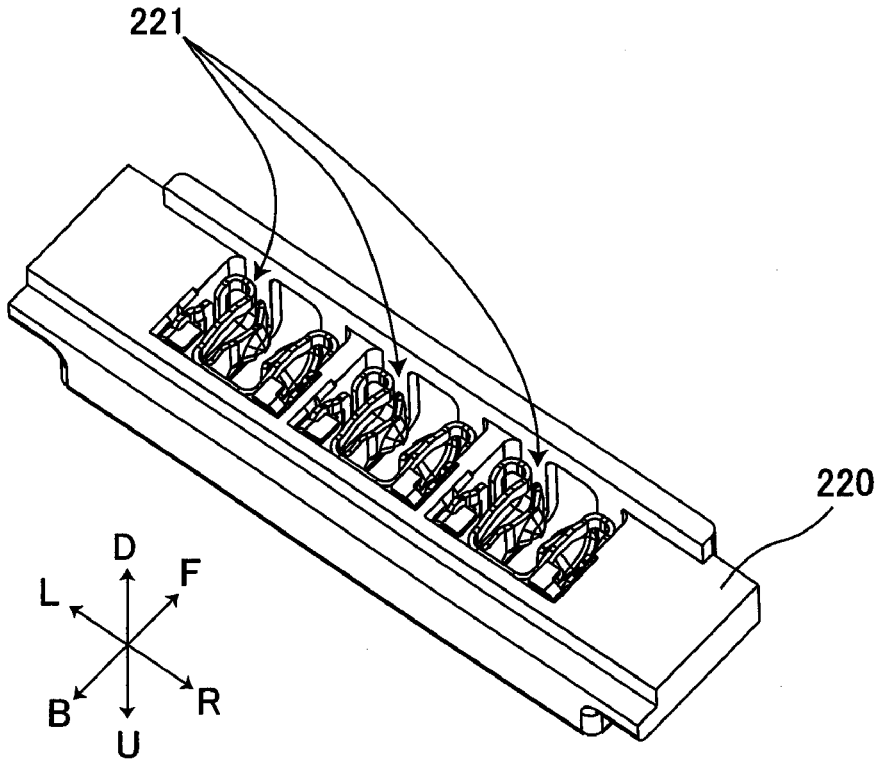
FIG. 5B is bottom perspective view of the electrical connector according to the invention.

As shown in FIGS. 5A and 5B, in the cover 220, three contact receiving chambers 221 are provided in the embodiment shown, and a window 222 is formed in each of the contact receiving chambers 221. Through the windows 222 of the cover 220, the contacts 331 of the mating connector 300 are electrically connected to the contacts 1, respectively.

Figure 7:
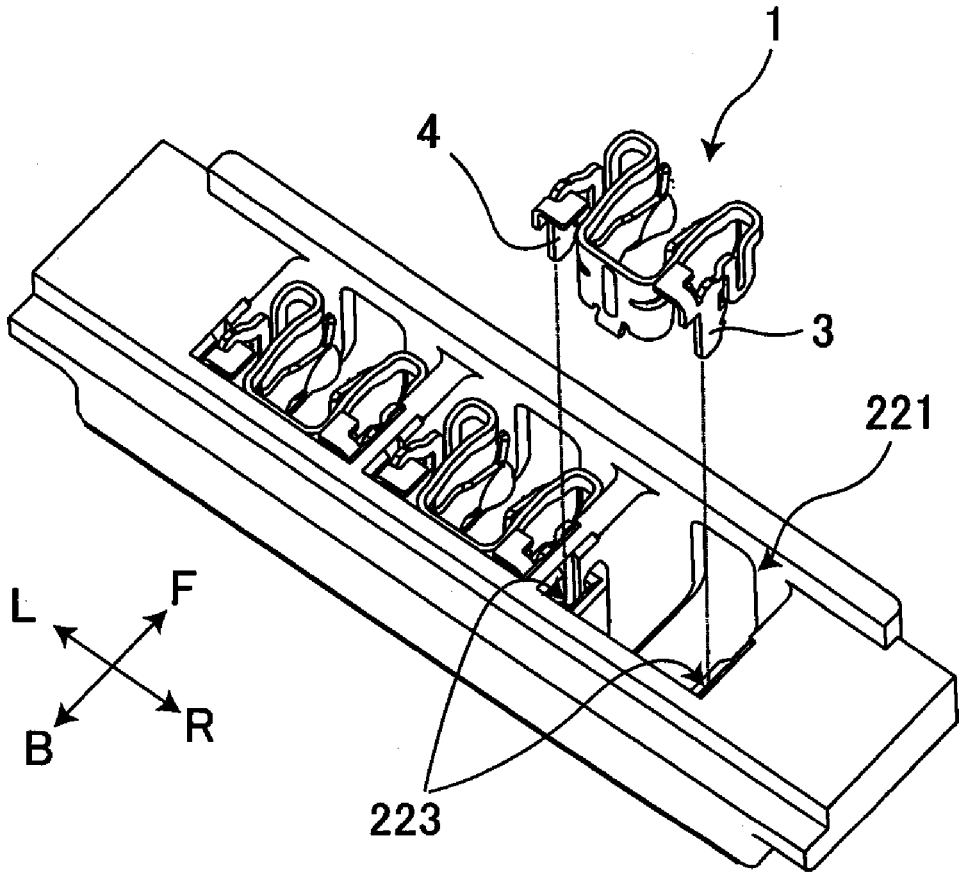
FIG. 7 is an exploded perspective view of the contact of FIG. 1A being attached to a cover according to the invention.

As shown in FIG. 7, fixing groove sections 223 are formed at walls that define the contact receiving chamber 221. When the contact 1 is housed in the contact receiving chamber 221, the tabs 3 and 4 are press-fit into the fixing groove sections 223.

As already described above, in the contact 1, the tabs 3 and 4 are located further in the backward direction B than the connection pads 21*a* and 22*a* at the tips of the arms 21 and 22. For this reason, the range in which the arms may move in the left-right direction LR is large, as compared with the known structures in which the tabs are aligned with the connection pads and located at the front. Further, when the range that allows the movement is maintained to the same extent as that of the conventional structure, it is possible to dispose the three contacts 1 in the connector 200 with narrowed spacing, by reducing the space between the pair of press fitted sections. In this case, the size of the connector and the component to which the connector is to be attached may be reduced due to narrowed pitching.

Furthermore, as described above with reference to, for example, FIGS. 2A to 2D, the contact arms 21 and 22 are reduced in the size in the forward and backward directions FB, namely, in the size in the forward and backward directions FB from the tips of the connection pads 21*a* and 22*a* provided at the front in the forward direction F of the contact arms 21 and 22 to the support 23. Moreover, by the reduction in the size of the contact arms 21 and 22 of the contact 1, the connector 200 containing the contacts 1 can be reduced in the size in the forward and backward directions FB. When the forward and backward directions FB are, for example, the thickness direction of the thin battery unit in which the connector 200 is provided, it is possible to reduce the thickness of the thin battery unit.

Figure 8:
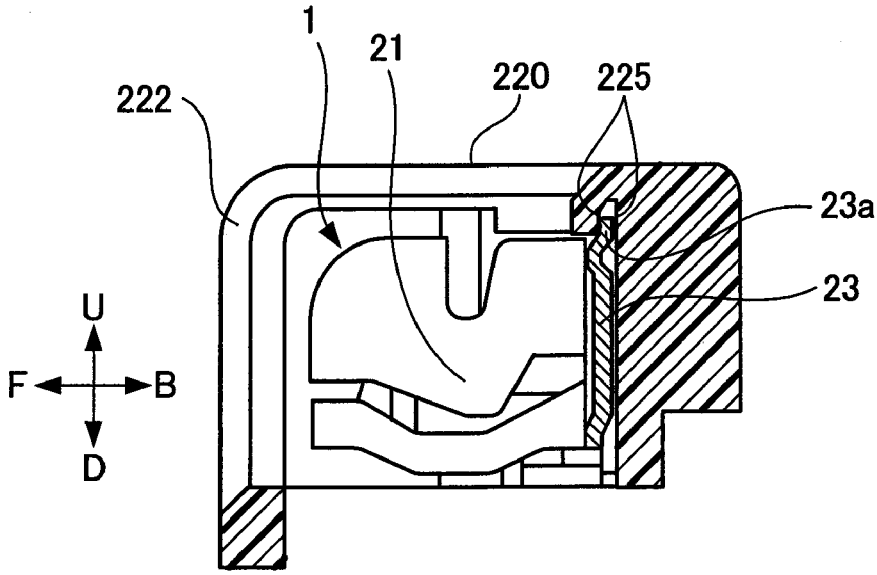
FIG. 8 is a cross-sectional diagram of the electrical connector according to the invention, showing a longitudinal section passing through the center of one of the contacts.
Figure 9:
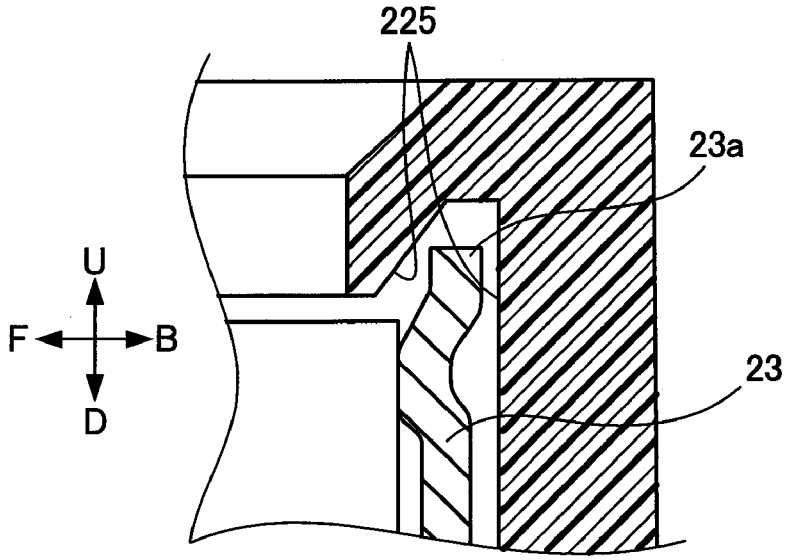
FIG. 9 is an enlarged cross-sectional view in which a part of the electrical connector illustrated in FIG. 8 is enlarged.

As illustrated in FIG. 8, the cover 220 has restricting walls 225 positioned away from the upper end of the support 23 of the contact 1, and surrounding this upper end in the forward and backward directions FB. To be more specific, as illustrated in FIG. 9, the restricting walls 225 are positioned away from the projection 23*a* at the upper end of the support 23 of the contact 1, to surround the projection 23*a* in the frontward and backward directions FB, thereby restricting the tilting of the support 23 in the forward and backward directions FB. Incidentally, since the restricting walls 225 and the projection 23*a* are away from each other, movement of the support 23 in the left and right directions LR is not obstructed.

When the contact 331 (FIG. 6) of the mating connector 300 is inserted between the contact arms 21 and 22 of the contact 1 from obliquely the upward direction U in the forward direction F, a force in the upward and downward directions UD is exerted on the tips of the contact arms 21 and 22 (see FIGS. 1A and 1B). However, the tilting of the support 23 in the forward and backward directions FB is restricted by the restricting walls 225 and thus, the tilting to the upward and downward directions UD of the contact arms 21 and 22 linking to the support 23 is restricted. For this reason, inappropriate twists and deformation in the contact 1, except shifting of the contact arms 21 and 22 in the opposite directions LR (see FIGS. 1A and 1B), are suppressed.

Incidentally, in the contact 1, the root parts of the tabs 3 and 4 and the substrate connectors 7 and 8 are folded besides the parts at the lines a and b. However, the contact is not limited to the shown embodiment, and additional folding for laying out the circuit board and the cover may be omitted. Further, in another embodiment of the invention, the number of the contacts 1 is three, but may be any number like four or five, other than three.

Moreover, in the connector 200 shown, the restricting walls 225 are positioned at the to surround the projection 23*a* projecting from the upper part of the support 23, from the forward and backward directions FB. However, the connector according to the invention is not limited to the embodiment shown, and for example, the support 23 may not be provided with a projecting portion, and the restricting walls 225 may be positioned to surround an upper part of the support 23.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. A contact, comprising:

a contact section that includes a pair of arms extending frontward while facing each other and a support bearing the pair of arms;

a pair of tabs located on left and right sides of the contact with the contact section positioned between; and a pair of springs having a sheared surface and bend from both left and right sides of the support respectively, the pair of springs first bend outwardly to right and left away from the contact section, around respective central axes extending vertically and maintaining the sheared surface facing up and down and then extend backward to link to the pair of tabs, respectively, the pair of springs supporting the contact section.

2. The contact according to claim 1, wherein the pair of tabs extend vertically.

3. The contact according to claim 2, wherein each of the pair of springs includes a first extending section that includes the sheared surface and extends from the support forward like a belt.

4. The contact according to claim 3, wherein each of the pair of springs further includes a first U-shaped section that curves around the central axis from a tip of the first extending section.

5. The contact according to claim 4, wherein each of the pair of springs further includes a second U-shaped section that extends upward from the first U-shaped section and further extends downward after bending backward.

6. The contact according to claim 5, wherein each of the pair of springs further includes a link section connecting a downwardly-extending lower end of the second U-shaped section with a lower end of the pair of tabs.

7. The contact according to claim 6, wherein the pair of arms bend forward from both the right and left sides of the support in positions higher than the pair of springs and extend forward and obliquely downward.

8. The contact according to claim 7, wherein the first extending section extends forward and obliquely downward while avoiding the contact with the pair of arms.

9. An electrical connector comprising:

a contact; and a housing to which the contact is attached, wherein the contact includes;

a contact section that includes a pair of arms extending frontward while facing each other and a support bearing the pair of arms;

a pair of tabs located on left and right sides of the contact with the contact section positioned between; and a pair of springs having a sheared surface and bend from both left and right sides of the support respectively, the pair of springs first bend outwardly to right and left away from the contact section, around respective central axes extending vertically and maintaining the sheared surface facing up and down and then extend backward to link to the pair of tabs, respectively, the pair of springs supporting the contact section.

10. The electrical connector according to claim 9, wherein the housing includes a mating contact receiving passageway.

11. The electrical connector according to claim 10, wherein the housing includes restricting walls positioned away from an upper end of the support.

12. The electrical connector according to claim 11, wherein the restricting walls surround the upper end from front and back.

13. The electrical connector according to claim 12, wherein the pair of tabs extend vertically.

14. The electrical connector according to claim 13, wherein each of the pair of springs includes a first extending section that includes the sheared surface and extends from the support forward like a belt.

15. The electrical connector according to claim 14, wherein each of the pair of springs further includes a first U-shaped section that curves around the central axis from a tip of the first extending section.

16. The electrical connector according to claim 15, wherein each of the pair of springs further includes a second U-shaped section that extends upward from the first U-shaped section and further extends downward after bending backward.

17. The electrical connector according to claim 16, wherein each of the pair of springs further includes a link section connecting a downwardly-extending lower end of the second U-shaped section with a lower end of the pair of tabs.

18. The electrical connector according to claim 17, wherein the pair of arms bend forward from both the right and left sides of the support in positions higher than the pair of springs and extend forward and obliquely downward.

19. The electrical connector according to claim 18, wherein the first extending section extends forward and obliquely downward while avoiding contact with the pair of arms.

20. A contact, comprising:

a support;

a contact section extended from the support, the contact section includes a pair of arms extending frontward while facing each other;

a pair of springs having a sheared surface and being bent from a left side and a right side of the support and;

a pair of tabs located on left and right sides of the contact with the contact section positioned between the pair of tabs and linked to the pair of springs, respectively, wherein the pair of springs are separated from the contact section.

21. The contact according to claim 20, wherein the pair of springs first bend outwardly to right and left away from the contact section, around respective central axes extending vertically and maintaining the sheared surface facing up and down and then extend backward to link to the pair of tabs, respectively, the pair of springs supporting the contact section.

22. The contact according to claim 21, wherein the pair of tabs extend vertically.

23. The contact according to claim 22, wherein each of the pair of springs includes a first extending section that includes the sheared surface and extends from the support forward with the sheared surface facing in each of the upward and downward directions.

24. The contact according to claim 23, wherein each of the pair of springs further includes a first U-shaped section that curves around the central axis from a tip of the first extending section.

25. The contact according to claim 24, wherein each of the pair of springs further includes a second U-shaped section that extends upward from the first U-shaped section and further extends downward after bending backward.

26. The contact according to claim 25, wherein each of the pair of springs further includes a link section connecting a downwardly-extending lower end of the second U-shaped section with a lower end of the pair of tabs.

27. The contact according to claim 26, wherein the pair of arms bend forward from both the right and left sides of the support in positions higher than the pair of springs and extend forward and obliquely downward,.

28. The contact according to claim 27, wherein the first extending section extends forward and obliquely downward while avoiding the contact with the pair of arms.

29. An electrical connector comprising:

a contact; and a housing to which the contact is attached, wherein the contact includes;

a support;

a contact section extended from the support, the contact section includes a pair of arms extending frontward while facing each other;

a pair of springs having a sheared surface and being bent from a left side and a right side of the support and;

a pair of tabs located on left and right sides of the contact with the contact section positioned between the pair of tabs and linked to the pair of springs, respectively, wherein the pair of springs are separated from the contact section.

30. The electrical connector according to claim 29, wherein the pair of springs first bend outwardly to right and left away from the contact section, around respective central axes extending vertically and maintaining the sheared surface facing up and down and then extend backward to link to the pair of tabs, respectively, the pair of springs supporting the contact section.

31. The electrical connector according to claim 30, wherein the housing includes a mating contact receiving passageway.

32. The electrical connector according to claim 31, wherein the housing includes restricting walls positioned away from an upper end of the support.

33. The electrical connector according to claim 32, wherein the restricting walls surround the upper end from front and back.

34. The electrical connector according to claim 33, wherein the pair of tabs extend vertically.

35. The electrical connector according to claim 34, wherein each of the pair of springs includes a first extending section that includes the sheared surface and extends from the support forward with the sheared surface facing in each of the upward and downward directions.

36. The electrical connector according to claim 35, wherein each of the pair of springs further includes a first U-shaped section that curves around the central axis from a tip of the first extending section.

37. The electrical connector according to claim 36, wherein each of the pair of springs further includes a second U-shaped section that extends upward from the first U-shaped section and further extends downward after bending backward.

38. The electrical connector according to claim 37, wherein each of the pair of springs further includes a link section connecting a downwardly-extending lower end of the second U-shaped section with a lower end of the pair of tabs.

39. The electrical connector according to claim 38, wherein the pair of arms bend forward from both the right and left sides of the support in positions higher than the pair of springs and extend forward and obliquely downward.

40. The electrical connector according to claim 39, wherein the first extending section extends forward and obliquely downward while avoiding contact with the pair of arms.

* * * * *